US009695679B2

(12) United States Patent
Leitch

(10) Patent No.: US 9,695,679 B2
(45) Date of Patent: Jul. 4, 2017

(54) DOWNHOLE ZONE FLOW CONTROL SYSTEM

(71) Applicant: CONOCOPHILLIPS COMPANY, Houston, TX (US)

(72) Inventor: John Cochrane Leitch, Magnolia, TX (US)

(73) Assignee: ConocoPhillips Company, Houston, TX (US)

( * ) Notice: Subject to any disclaimer, the term of this patent is extended or adjusted under 35 U.S.C. 154(b) by 113 days.

(21) Appl. No.: 14/518,069

(22) Filed: Oct. 20, 2014

(65) Prior Publication Data

US 2015/0107848 A1 Apr. 23, 2015

Related U.S. Application Data

(60) Provisional application No. 61/894,512, filed on Oct. 23, 2013.

(51) Int. Cl.

| | |
|---|---|
| ***E21B 43/12*** | (2006.01) |
| ***E21B 43/14*** | (2006.01) |
| ***E21B 23/04*** | (2006.01) |
| ***E21B 34/10*** | (2006.01) |

(52) U.S. Cl.

CPC ..... *E21B 43/12* (2013.01); *E21B 34/10* (2013.01); *E21B 43/14* (2013.01)

(58) Field of Classification Search

CPC ..... E21B 34/10; E21B 23/04
USPC ..... 166/319, 374, 375; 340/853.3
See application file for complete search history.

(56) References Cited

U.S. PATENT DOCUMENTS

| | | | | |
|---|---|---|---|---|
| 6,567,013 | B1 | 5/2003 | Purkis et al. | |
| 2001/0037884 | A1 | 11/2001 | Schultz et al. | |
| 2002/0014338 | A1 * | 2/2002 | Purkis | E21B 34/10 166/375 |
| 2009/0065218 | A1 | 3/2009 | Loretz et al. | |
| 2010/0236790 | A1 | 9/2010 | Smithson | |
| 2011/0100645 | A1 * | 5/2011 | Yapici | E21B 23/04 166/375 |
| 2013/0056222 | A1 | 3/2013 | Smith et al. | |

OTHER PUBLICATIONS

Tirado, R. A. (Jan. 1, 2009). Hydraulic Intelligent Well Systems in Subsea Applications: Options for Dealing With Limited Control-Line Penetrations. Society of Petroleum Engineers. doi:10.2118/124705-MS.

Halliburton WellDynamics, Company Brochure, 54 pages, Apr. 28, 2011.

* cited by examiner

*Primary Examiner* — George Gray
(74) *Attorney, Agent, or Firm* — ConocoPhillips Company

(57) ABSTRACT

Methods and systems operate multiple downhole tools in wells based on hydraulic pressures supplied in control lines. The methods and systems pair each of the tools with a manifold enabling selective actuation of each of the tools from a remote location. Some embodiments include between three and twelve manifold and tool pairs configured for control independent from one another with four of the control lines.

14 Claims, 5 Drawing Sheets

DOWNHOLE ZONE FLOW CONTROL SYSTEM

CROSS-REFERENCE TO RELATED APPLICATIONS

This application is a non-provisional application which claims benefit under 35 USC §119(e) to U.S. Provisional Application Ser. No. 61/894,512 filed Oct. 23, 2013, entitled "DOWNHOLE ZONE FLOW CONTROL SYSTEM," which is incorporated herein in its entirety.

FIELD OF THE INVENTION

The present invention relates generally to operations performed in conjunction with downhole wells.

BACKGROUND OF THE INVENTION

Intelligent wells include downhole remote flow-control devices used to open, close or regulate flow from and to multiple zones without the need for well intervention. Furthermore, intelligent wells are usually complemented by downhole permanent monitoring systems which provide valuable information used in the decision making process for the control of production or injection. All these systems require multiple control lines and cables to link the downhole tools to the associated surface equipment which serves as the interface between the operator and the system.

Current types of intelligent well systems in the industry include all electric, electro-hydraulic and all hydraulic systems. Most of the intelligent wells installed to date utilize hydraulic systems. Reasons for this preference for all hydraulic systems include lower costs, less complexity, perceived higher reliability and faster delivery times.

In hydraulic systems, the flow control devices can be either on/off or multi-position valves and can have either balanced piston or spring return type actuators. On the balanced piston design, two control lines are used for the operation of each valve, with each control line ported to either side of the piston ("open" and "close" ports). Applying hydraulic fluid pressure on one control line while the other is vented moves the valve in one direction with movement of the valve in an opposite direction accomplished by inverting the operation. On the spring return design, the valve operates with only one control line. Applying pressure to the single control line moves the valve in one direction, and, when this pressure is bled off, a mechanical or pneumatic spring moves the valve in the opposite direction.

Therefore, a need exists for multiplexed hydraulic control for operation of tools in a wellbore.

SUMMARY OF THE INVENTION

For one embodiment, a method of actuating a well tool includes applying hydraulic pressure through a first control line to a set input of a manifold thereby opening a communication path for a fire input of the manifold. Applying hydraulic pressure through a second control line to the fire input while holding pressure on the set input establishes flow pathways for a third control line to a first side of a hydraulic operated element and a fourth control line to a second side of the hydraulic operated element. Further, applying hydraulic pressure through at least one of the third and fourth control lines actuates the well tool.

According to one embodiment, a system for actuating well tools includes four hydraulic control lines and at least eight of the well tools. The system also includes zone control manifolds deployed downhole. The manifolds control which of the tools is selected with two of the control lines and independent functioning of a selected one of the tools with two of the control lines in response to hydraulic pressure supplied to the four hydraulic control lines.

In one embodiment, a manifold for actuating a well tool includes a first piston for selective passage of fluid from a first control line when fluid pressure is not applied to a second control line. The manifold includes a second piston for selective passage of fluid from the second control line when fluid pressure from the first control line is passed through the first piston and held to operate the second piston. A third piston actuates by fluid pressure from the second control line passed through the second piston for movement of the third piston from having fluid communication blocked to the tool to having flow pathways established for a third control line to a first side of a hydraulic operated element of the tool and a fourth control line to a second side of the hydraulic operated element.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE INVENTION

Reference will now be made in detail to embodiments of the present invention, one or more examples of which are illustrated in the accompanying drawings. Each example is provided by way of explanation of the invention, not as a limitation of the invention. It will be apparent to those skilled in the art that various modifications and variations can be made in the present invention without departing from the scope or spirit of the invention. For instance, features illustrated or described as part of one embodiment can be used in another embodiment to yield a still further embodiment. Thus, it is intended that the present invention cover such modifications and variations that come within the scope of the appended claims and their equivalents.

Methods and systems operate multiple downhole tools in wells based on hydraulic pressures supplied in control lines. The methods and systems pair each of the tools with a manifold enabling selective actuation of each of the tools from a remote location. Some embodiments include between three and twelve manifold and tool pairs configured for control independent from one another with four of the control lines.

Figure 1:
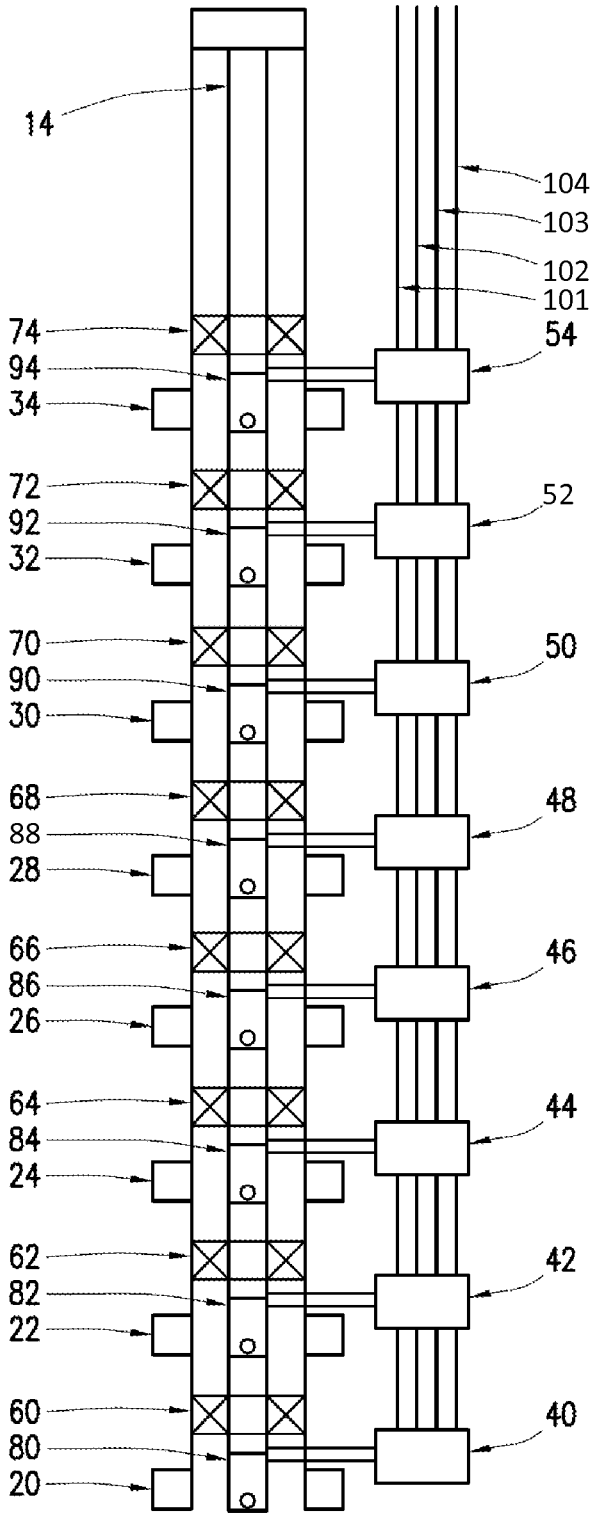
FIG. 1 depicts a zone control multiplexing system, according to one embodiment of the invention.

FIG. 1 shows eight zones 20, 22, 24, 26, 28, 30, 32, 34 for downhole flow control intersecting a casing string. The following description assumes that it is desired to produce fluids to the earth's surface from one or more of the zones 20, 22, 24, 26, 28, 30, 32, 34 via a production string 14. However, principles of the present invention are not limited to production wells, production from multiple zones or any of specific details described herein. For example, embodiments of the invention may be used in injection wells where fluid flow into a formation is to be controlled or methods where an aspect of the well other than fluid flow is to be controlled. Thus, the description of the present method and system is an example of the wide variety of uses for the principles of the present invention.

The production string 14 as depicted in FIG. 1 includes eight zone control manifolds 40, 42, 44, 46, 48, 50, 52, 54. The production string 14 also includes production packers 60, 62, 64, 66, 68, 70, 72, 74 for isolating the zones from one another. Four hydraulic control lines (also referred to as first, second, third and fourth hydraulic lines) 101, 102, 103, 104 send signals to the zone control manifolds 40, 42, 44, 46, 48, 50, 52, 54 to operate respective downhole control valves 80, 82, 84, 86, 88, 90, 92, 94.

The four hydraulic control lines 101, 102, 103, 104 with manifold designs described herein provide independent control of up to twelve tools even though only eight of the valves 80, 82, 84, 86, 88, 90, 92, 94 are shown by example. If desired, one or more tools may operate together (i.e., not independent of one another) by having alike control line inputs and thereby enable control of more than twelve tools. In some embodiments, the four hydraulic lines 101, 102, 103, 104 control at least four tools, or at least eight tools, independent of one another.

Figure 2:
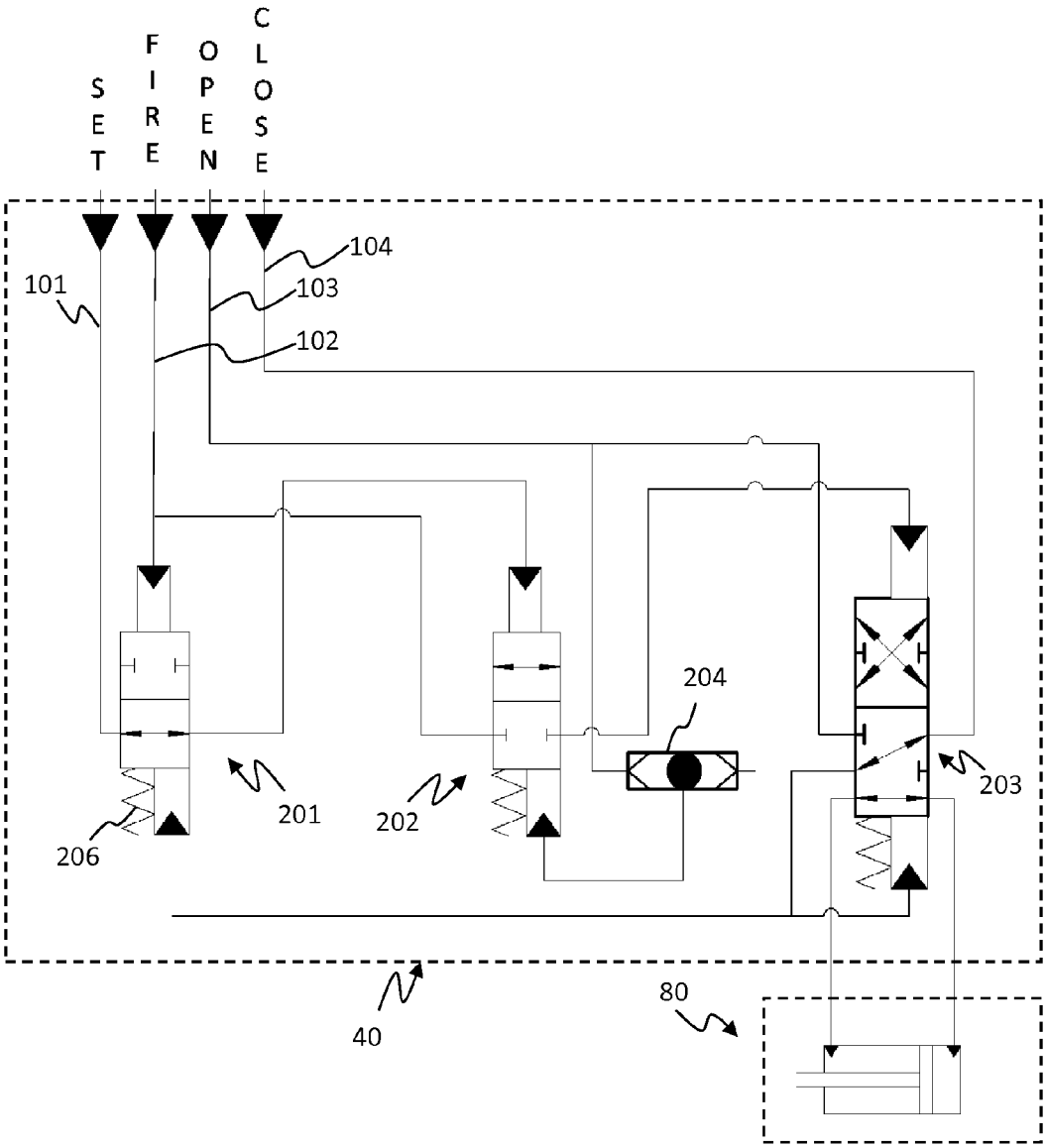
FIG. 2 depicts a manifold of the zone control operation in a deactivated state, according to one embodiment of the invention.

FIG. 2 illustrates the manifold 40 associated with the downhole control valve 80 and in a deactivated state. The manifold 40 includes a first piston 201, a second piston 202 and a third piston 203, which are in fluid communication with the four hydraulic lines 101, 102, 103, 104. Outputs of the third piston 203 provide fluid communication for actuation of the valve 80 with a hydraulic operated element of the valve 80 represented for illustration purposes as a schematic valve piston.

The four hydraulic control lines 101, 102, 103, 104 couple to a "set" input, a "fire" input, an "open" input and a "close" input into each of the manifolds 40, 42, 44, 46, 48, 50, 52, 54. While the manifolds 40, 42, 44, 46, 48, 50, 52, 54 with these inputs may all be configured alike, the control lines 101, 102, 103, 104 in fluid communication with these inputs differ for each of the manifolds 40, 42, 44, 46, 48, 50, 52, 54 to enable the independent control of individual tools. An assignment of the control lines 101, 102, 103, 104 to the inputs for twelve unique zones follows:

| | Zone (Manifold) | | | | | | | | | | | |
|---|---|---|---|---|---|---|---|---|---|---|---|---|
| Line | 1 (40) | 2 (42) | 3 (44) | 4 (45) | 5 (46) | 6 (48) | 7 (50) | 8 (52) | 9 | 10 | 11 | 12 |
| 101 | SET (S) | S | S | O | O | O | F | F | F | O | O | O |
| 102 | FIRE (F) | O | O | S | S | C | S | O | O | F | F | C |
| 103 | OPEN (O) | F | C | F | C | S | O | S | C | S | C | F |
| 104 | CLOSE (C) | C | F | C | F | F | C | C | S | C | S | S |

For example with respect to the manifold 40, the first hydraulic line 101 couples to the set input. The second hydraulic line 102 couples to the fire input of the manifold 40. The third hydraulic line 103 and the fourth hydraulic line 104 provide hydraulic pressure through the manifold 40 to operate the valve 80 and are thus the open and close inputs. For some embodiments, a biasing member may provide return movement of the valve 80 instead of pressure supplied through one of the control lines 101, 102, 103, 104.

Biasing mechanisms, such as a spring 206 for the first piston 201, urge the pistons 201, 202, 203 to positions as in the deactivated state. The biasing mechanisms facilitate resetting of the pistons 201, 202, 203 after operation of the valve 80. Force supplied by the biasing mechanisms may be less than pressure supplied through the hydraulic lines 101, 102, 103, 104. As described further herein, the biasing mechanisms also may reset any of the pistons 201, 202, 203 due to differential force created when combined with hydraulic pressure from one of the control lines 101, 102, 103, 104 even when fluid pressure from another one of the control lines 101, 102, 103, 104 is acting in operational opposition on one of the pistons 201, 202, 203.

Supply sequence for fluid pressure to the control lines 101, 102, 103, 104 determines based on functioning of the pistons 201, 202, 203 whether the manifold 40 is activated to control the valve 80. In the deactivated state, the first piston 201 permits the flow from the first hydraulic line 101 to an operator of the second piston 202. Operation starts by supplying fluid pressure to the first hydraulic line 101.

Figure 3:
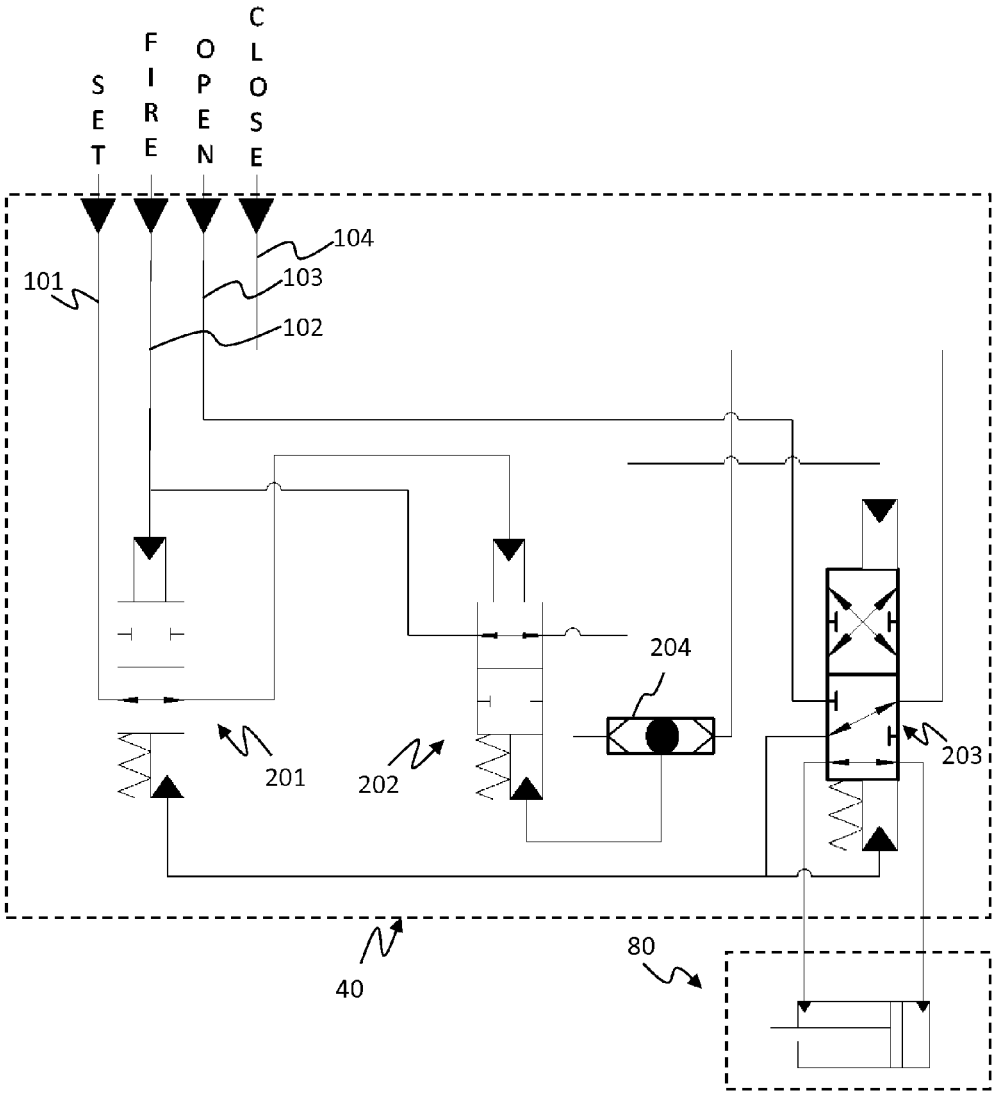
FIG. 3 depicts the manifold of the zone control operation in a set state, according to one embodiment of the invention.

FIG. 3 shows the manifold 40 in a set state after the pressure is supplied through the first hydraulic line 101. In operation from the deactivated state to the set state, the pressure supplied to the operator of the second piston 202 shifts the second piston 202 from blocking communication between the second hydraulic line 102 and an operator of the third piston 203 to providing a flow path for the second hydraulic line 102 to the operator of the third piston 203. The sequence for the manifold 40 to be selected next requires supplying pressure to the second hydraulic line 102 while pressure is supplied through the first hydraulic line 101.

Figure 4:
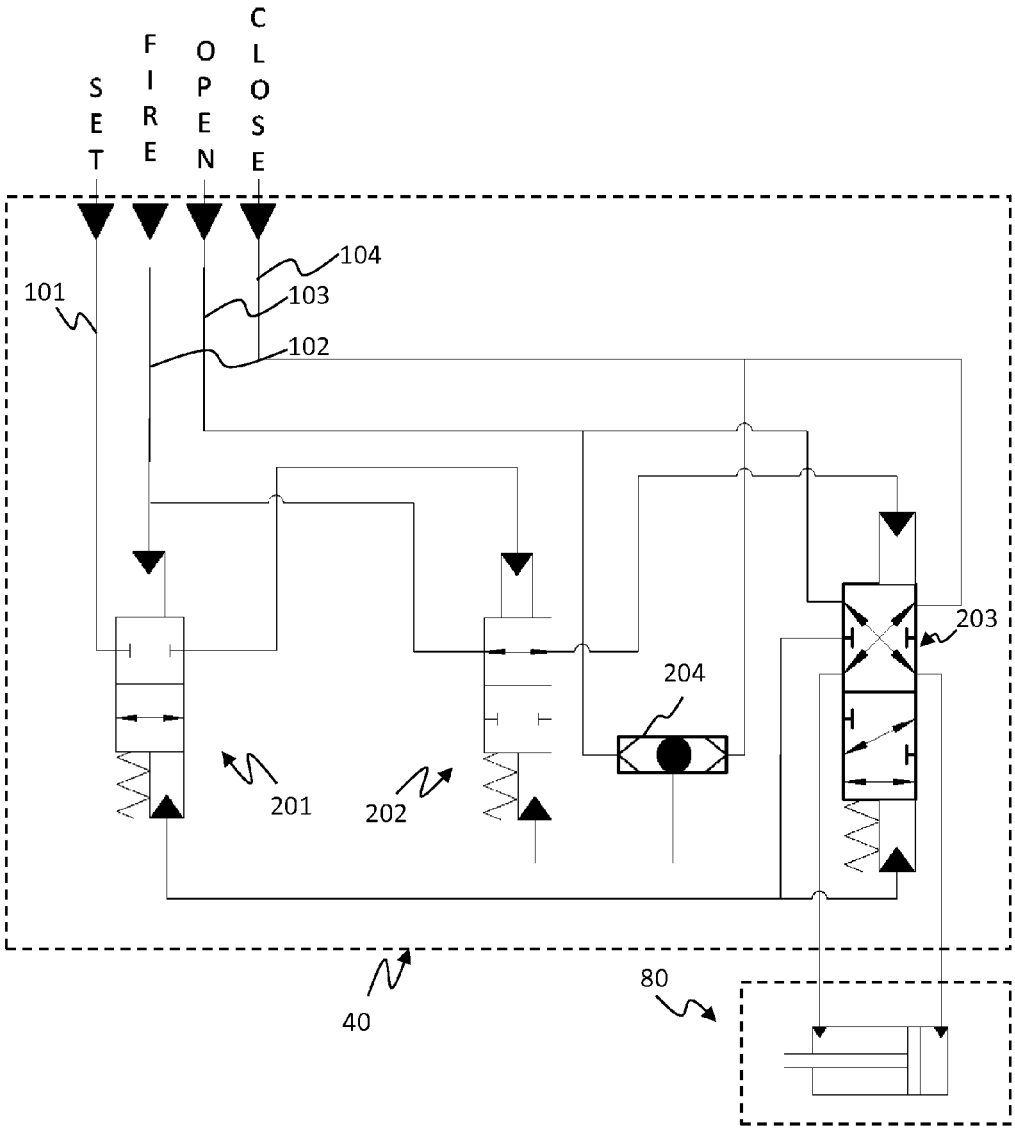
FIG. 4 depicts the manifold of the zone control operation in a fire state, according to one embodiment of the invention.

FIG. 4 illustrates the manifold 40 in a fire state after the second hydraulic line 102 is pressurized. The fluid pressure in the second hydraulic line 102 acts on an operator for the first piston 201 shifting the first piston 201 and closing the flow path of the first hydraulic line 101 to the operator of the second piston 202. Since this closing occurs with pressure supplied in the first hydraulic line 101, trapped pressure continues to actuate the second piston 202 against force of the biasing mechanism.

The pressure in the second hydraulic line 102 also passes through the flow path opened within the second piston 202 to the operator of the third piston 203 for shifting the third piston 203. In the deactivated and set states, the third piston 203 remains biased to provide a fluid path across the hydraulic operated element of the valve 80 and a fluid path connecting the fourth control line 104 to counteracting sides of the first and third pistons 201, 203 to provide a drain for fluid during movement of the pistons 201, 203. The shifting of the third piston 203 to the fire state places the third hydraulic line 103 in fluid communication with a first side of the hydraulic operated element of the valve 80 and the fourth hydraulic line 104 in fluid communication with a second side of the hydraulic operated element of the valve 80 to provide opposing forces to the valve 80 and closes all other fluid pathways through the third piston 203.

Figure 5:
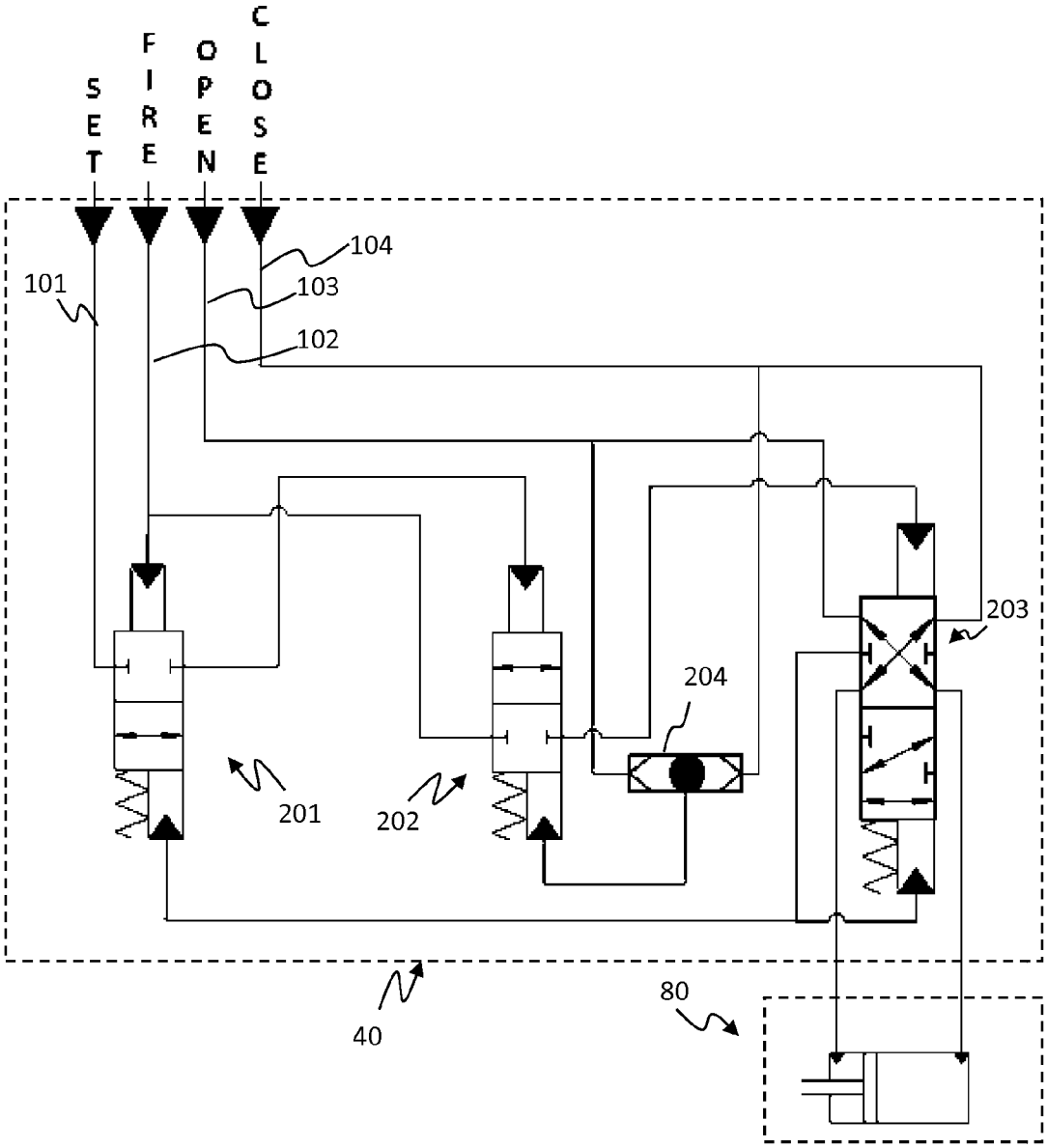
FIG. 5 depicts the manifold of the zone control operation in an operational state with a downhole valve opened, according to one embodiment of the invention.

FIG. 5 shows the manifold 40 in an operational state with the valve 80 having moved position, e.g., from closed to open. The valve 80 moves as a result of supplying pressure to the third hydraulic line 103 since the manifold 40 acts like a direct hydraulic system to the valve 80 once in the operational state. Relieving pressure in the third hydraulic line 103 and supplying pressure to the fourth hydraulic control line 104 thus enables return movement of the valve 80, e.g., from open to closed, without any further pressure manipulation.

The hydraulic pressure in the third and/or fourth lines 103, 104 also shift position of the second piston 202. In particular, a diverter valve 204 also couples to the third and fourth lines 103, 104 and has an output to the second valve 202 in opposition to the operation of the second valve 202 by the pressure from the first hydraulic line 101. The diverter valve 204 includes a floating ball pushed by fluid pressure in whichever of the third and fourth lines 103, 104 is pressurized to block fluid transfer across the third and fourth lines 103, 104. The fluid pressure supplied from the third and/or fourth hydraulic lines 103, 104 thus causes the flow path of the second hydraulic line 102 through the second piston 202 to be blocked from the third piston 203. Similar to the shifting of the first piston 201, trapped fluid pressure maintains the third piston 203 actuated after shifting of the second piston 202.

To reset the manifold 40, the control lines 101, 102, 103, 104 vent to relieve fluid pressure. The biasing mechanisms facilitate return of the pistons 201, 202, 203 to the deactivated state. For some embodiments, this resetting equalizes fluid pressure across the valve 80 and relocates the third piston 203 back to the deactivated state providing fluid communication across the hydraulic operated element of the valve 80. Having chambers of the valve 80 in direct fluid communication and balanced thus facilitates manual movement of the valve 80 through use of coil tubing/wireline.

Other sequences of pressure supplied to the control lines 101, 102, 103, 104 fail to operate the valve 80 with the manifold 40 making the independent control possible. For example, starting with pressure supplied to the second hydraulic line 102 shifts the first piston 201 locking out the first hydraulic line 101 from being able to operate the second piston 202. Starting with either of the third and fourth lines 103, 104 shifts the first and/or second pistons 201, 202 to at least lock out the second hydraulic line 102 from being able to operate the third piston 203.

In some embodiments, the manifold 40 may not include the first piston 201 and may couple the first hydraulic control line 101 direct to the operator of the second piston 202. Omission of the first piston 201 reduces the total independent zones able to be controlled with the control lines 101, 102, 103, 104. However, functioning otherwise remains as already set forth.

The control lines 101, 102, 103, 104 extend to the earth's surface, or another remote location, where fluid pressure on each of the lines may be controlled using conventional pumps, valves, accumulators and computerized controls. In some embodiments, the manifold 40 operates on a single level pressure supply to the control lines 101, 102, 103, 104 giving the option of using on any standard sub-sea control system without relying variable or different pressures. The sequence described herein of transmitting a code or address via the control lines 101, 102, 103, 104 provides more reliable and easier operation compared to applying a series of pressure pulses on a hydraulic line.

The manifolds described herein can operate any currently available hydraulically operated downhole flow control valves, variable position chokes and other devices. Embodiments of the invention can operate using any standard subsea control system that has four (4) hydraulic lines available for downhole tool actuation. In conjunction with an indexing type valve, such valve may move by alternating pressure on the open and close inputs for the specific zone, thus giving multiple choking positions for each zone and up to twelve (12) zones. Additionally, both subsea and surface control systems may employ the zone control described herein.

Fluid used within the control lines 101, 102, 103, 104 may include oil based control line fluids or water based control fluids. The manifold 40 design may fit inside standard well bore diameters and may be modular to adapt to standard downhole flow control valves. Aspects of the invention provide proper operation of the valve 80 even with fine particles in the control line fluid which can create malfunction in other systems.

In closing, it should be noted that the discussion of any reference is not an admission that it is prior art to the present invention, especially any reference that may have a publication date after the priority date of this application. At the same time, each and every claim below is hereby incorporated into this detailed description or specification as a additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A method of actuating a well tool, comprising:

applying a first hydraulic pressure through a first control line to a set input of a manifold thereby opening a first communication path for a fire input of the manifold;

then applying a second hydraulic pressure through a second control line to the fire input while holding the first hydraulic pressure on the set input to maintain the open first communication path thereby establishing flow pathways for a third control line to a first side of a hydraulic operated element and a fourth control line to a second side of the hydraulic operated element; and then applying a third hydraulic pressure through at least one of the third and fourth control lines for actuation of the well tool wherein each manifold includes a first piston having a passage through which fluid from one of the control lines passes to an operator for a second piston configured to open a communication path for another one of the control lines coupled to operate the first piston and upon pressurization block the passage through the first piston.

2. The method according to claim 1, wherein the well tool and the manifold are one of at least eight tool and manifold pairs deployed downhole to provide independent control for each of the tools in response to hydraulic pressure supplied by the first, second, third and fourth control lines.

3. The method according to claim 1, wherein the well tool and the manifold are one of twelve tool and manifold pairs deployed downhole to provide independent control for each of the tools in response to hydraulic pressure supplied by the first, second, third and fourth control lines.

4. The method according to claim 1, wherein the tool is a valve.

5. The method according to claim 1, wherein the hydraulic pressure applied to all the control lines is from a single level pressure supply.

6. The method according to claim 1, wherein the hydraulic pressure applied to all the control lines is from a single level pressure supply and twelve tool and manifold pairs provide independent control for each of the tools in response to the hydraulic pressure supplied by the first, second, third and fourth control lines.

7. The method according to claim 1, wherein the applying pressure to the third control line while venting the fourth control line opens a valve operating the well tool.

8. The method according to claim 1, wherein the applying pressure to the third control line while venting the fourth control line opens a valve operating the well tool and the applying pressure to the fourth control line while venting the third control line closes the valve.

9. The method according to claim 1, further comprising releasing the hydraulic pressure applied to the first, second, third and fourth control lines thereby creating direct fluid communication across the hydraulic operated element and resetting the manifold by closing the communication path and the flow pathways.

10. The method according to claim 1, wherein the set input passes through a first piston of the manifold to an operator for a second piston configured to open the communication path and the fire input is coupled to operate the first piston and block the set input from passing through the first piston.

11. The method according to claim 1, wherein the third and fourth control lines couple to a piston in the manifold so once the pressure is applied to either of the third and fourth control lines the communication path for the fire input is blocked preventing ability of the fire input to establish the flow pathways.

12. A manifold for actuating a well tool, comprising:

a first piston for selective passage of fluid from a first control line when fluid pressure is not applied to a second control line;

a second piston for selective passage of fluid from the second control line when a first fluid pressure from the first control line is passed through the first piston and held to operate the second piston; and a third piston actuated by a second fluid pressure from the second control line passed through the second piston for movement of the third piston from having fluid communication blocked to the tool to having flow pathways established for a third control line to a first side of a hydraulic operated element of the tool and a fourth control line to a second side of the hydraulic operated element.

13. The manifold according to claim 12, wherein fluid pressure applied to either the third or fourth control lines blocks the passage of fluid from the second control line through the second piston regardless of the first fluid pressure applied from the first control for operation of the second piston.

14. The manifold according to claim 12, wherein the pistons are biased to return the manifold to a deactivated state upon release of fluid pressure in the control lines.

* * * * *